US007806617B2

(12) United States Patent
Ballidis

(10) Patent No.: US 7,806,617 B2
(45) Date of Patent: Oct. 5, 2010

(54) DOCUMENT BINDING SYSTEM

(76) Inventor: James Ballidis, 4400 MacArthur Blvd., Suite 370, Newport Beach, CA (US) 92660

( * ) Notice: Subject to any disclaimer, the term of this patent is extended or adjusted under 35 U.S.C. 154(b) by 147 days.

(21) Appl. No.: 11/733,597

(22) Filed: Apr. 10, 2007

(65) Prior Publication Data

US 2008/0290646 A1 Nov. 27, 2008

(51) Int. Cl.

| | |
|---|---|
| ***B42F 13/36*** | (2006.01) |
| ***B42F 13/12*** | (2006.01) |
| ***B42F 3/00*** | (2006.01) |
| ***B42D 1/00*** | (2006.01) |

(52) U.S. Cl. ..... 402/63; 402/60; 402/64; 402/68; 281/21.1

(58) Field of Classification Search ..... 402/60, 402/63, 64, 68, 65–66; 24/67.1; 281/21.1; 215/272, 295

See application file for complete search history.

(56) References Cited

U.S. PATENT DOCUMENTS

| | | | | | |
|---|---|---|---|---|---|
| 764,413 | A | * | 7/1904 | Baxter, Jr. | 402/63 |
| 1,686,780 | A | * | 10/1928 | Wigginton | 281/27.3 |
| 3,232,420 | A | * | 2/1966 | Haenle, Jr. | 206/575 |
| 3,251,260 | A | * | 5/1966 | Serdechnny | 411/338 |
| 4,175,880 | A | | 11/1979 | Müller | |
| 4,583,654 | A | * | 4/1986 | Pufpaff et al. | 220/789 |
| 4,730,972 | A | | 3/1988 | Sun et al. | |
| 4,743,048 | A | | 5/1988 | Groswith, III | |
| 4,874,186 | A | * | 10/1989 | Groswith III et al. | 281/28 |
| 4,893,836 | A | | 1/1990 | Groswith, III et al. | |
| 4,930,927 | A | | 6/1990 | Dumas | |
| 4,997,208 | A | | 3/1991 | Staats, III | |
| 5,080,398 | A | | 1/1992 | Groswith, III | |
| 5,690,443 | A | | 11/1997 | Sullivan | |
| 6,578,240 | B2 | | 6/2003 | Fortenberry | |
| 6,736,563 | B1 | * | 5/2004 | With | 402/60 |
| D571,898 | S | * | 6/2008 | Gilligan | D23/260 |
| 2002/0004661 | A1 | * | 1/2002 | Sevrain et al. | 606/73 |
| 2004/0052572 | A1 | * | 3/2004 | Peters | 402/60 |
| 2004/0123997 | A1 | * | 7/2004 | Drane et al. | 174/67 |
| 2007/0137122 | A1 | * | 6/2007 | Peaco | 52/233 |

OTHER PUBLICATIONS

Patent Cooperation Treaty, International Search Report and Written Opinion of the International Searching Authority, PCT/US08/64855, Nov. 3, 2008, 10 pages.

* cited by examiner

*Primary Examiner*—Dana Ross
*Assistant Examiner*—Kyle Grabowski
(74) *Attorney, Agent, or Firm*—Neustel Law Offices

(57) ABSTRACT

A document binding system for efficiently securing a plurality of documents together in a professional manner. The document binding system generally includes a first support including at least one post and a second support including at least one opening. The post extends outwardly from the first support and the opening extends through the second support. The post includes a plurality of teeth ending along an outer surface of the post and the opening includes a locking member extending within, wherein the locking member selectively engages at least one of the teeth to secure the first support to the second support, wherein a plurality of documents are preferably selectively secured between the first support and the second support.

4 Claims, 9 Drawing Sheets

DOCUMENT BINDING SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to document binders and more specifically it relates to a document binding system for efficiently securing a plurality of documents together in a professional manner.

2. Description of the Related Art

Any discussion of the prior art throughout the specification should in no way be considered as an admission that such prior art is widely known or forms part of common general knowledge in the field.

Document binders have been in use for years. Typically, document binders may be comprised of various configurations, such as but not limited to binder clips, staples, paper clips, folders, metal clips, three-ring binders and various others. Documents, as described in the present invention, include any paper, cloth, leather, photograph or other product that is desired to be secured to another document or stand alone. The document may include various markings, such as but not limited to written/typed text, sketches, paintings and/or pictures.

Common document binder mechanisms (i.e. staples, paper clips, metal clips, etc.) may not offer the professionalism in appearance that some businesses desire. The number of documents that the staples, paper clips, etc. can hold are also generally limited. Other more permanent document binder mechanisms may require complicated hole punching, heating devices and trimming devices which can make the use of them unsatisfactory. Because of the general lack of efficiency and practicality in the prior art there is the need for a new and improved document binding system for efficiently securing a plurality of documents together in a professional manner.

BRIEF SUMMARY OF THE INVENTION

The general purpose of the present invention is to provide a document binding system that has many of the advantages of the document binders mentioned heretofore. The invention generally relates to a document binder which includes a first support including at least one post and a second support including at least one opening. The post extends outwardly from the first support and the opening extends through the second support. The post includes a plurality of teeth extending along an outer surface of the post and the opening includes a locking member extending within, wherein the locking member selectively engages at least one of the teeth to secure the first support to the second support.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

An object is to provide a document binding system for efficiently securing a plurality of documents together in a professional manner.

Another object is to provide a document binding system that appears professional (i.e. neat, clean, etc.) when in use.

An additional object is to provide a document binding system that does not require glue, heat or other cumbersome equipment to assemble/disassemble.

A further object is to provide a document binding system that is easy to use.

Another object is to provide a document binding system that is inexpensive.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
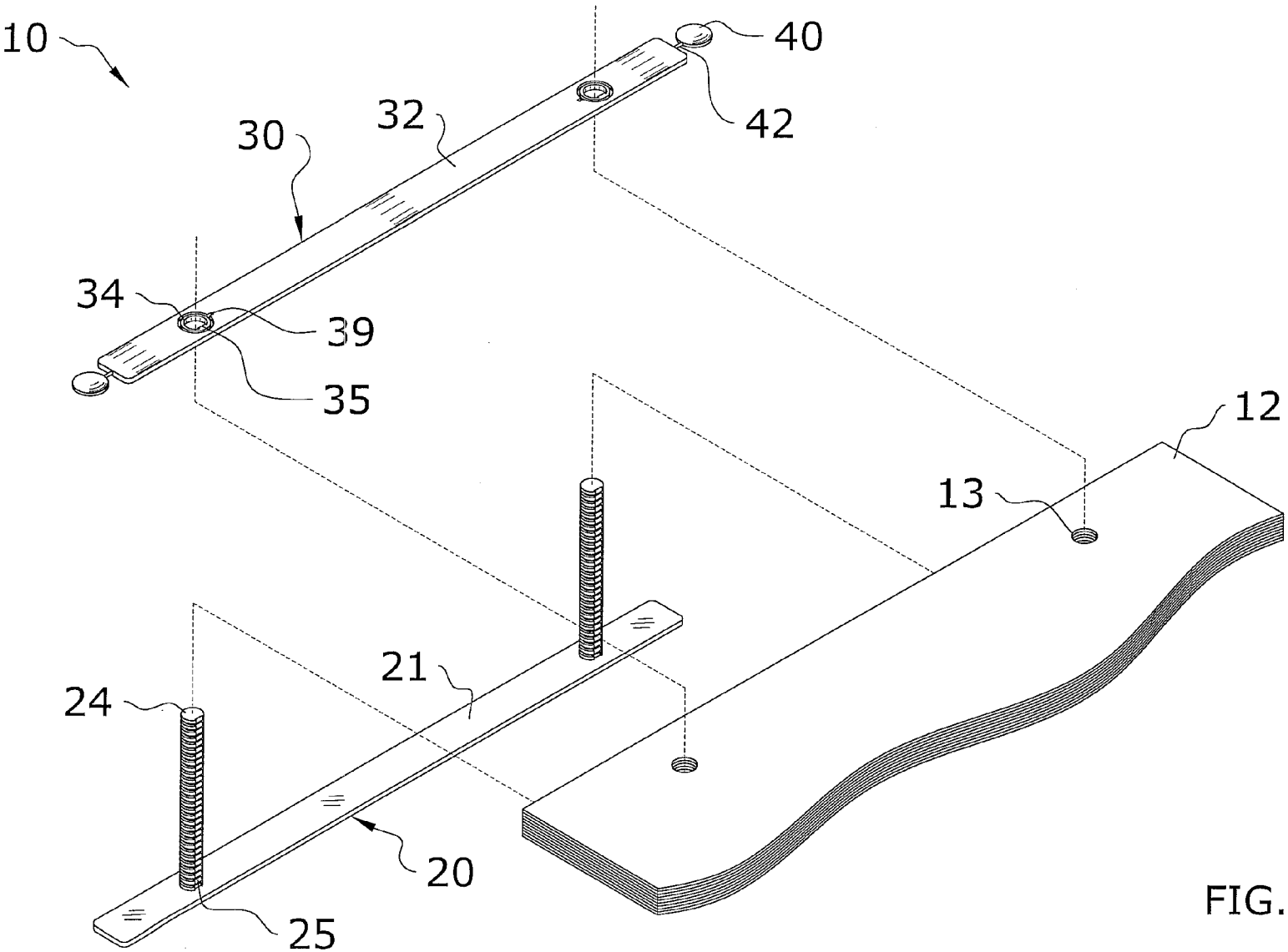
FIG. 1 is an upper perspective view of the present invention exploded from a plurality of documents.

Turning now descriptively to the drawings, in which similar reference characters denote similar elements throughout the several views, FIGS. 1 through 9 illustrate a document binding system 10, which comprises a first support 20 including at least one post 24 and a second support 30 including at least one opening 34. The post 24 extends outwardly from the first support 20 and the opening 34 extends through the second support 30. The post 24 includes a plurality of teeth 25 ending along an outer surface of the post 24 and the opening 34 includes a locking member 35 extending within, wherein the locking member 35 selectively engages at least one of the teeth 25 to secure the first support 20 to the second support 30, wherein a plurality of documents 12 are preferably selectively secured between the first support 20 and the second support 30.

B. First Support

The first support 20 is comprised of an elongated configuration. The first support 20 is preferably positioned over a plurality of holes 13 extending along a side of a plurality of documents 12 as illustrated in FIGS. 1 through 5. The first support 20 preferably extends substantially along an entire edge of the plurality of documents 12 as illustrated in FIGS. 1 through 5. It is appreciated that the first support 20 may extend along a longitudinal edge of the documents 12 or an adjacent edge (i.e. top edge, bottom edge) of the documents 12.

The first support 20 may be comprised of various materials such as but not limited to plastic, metal or wood. The first support 20 is preferably comprised of a substantially rigid material so as to provide adequate support along a given edge of the documents 12. The first support 20 is also comprised of a configuration to provide a professional appeal (i.e. sleek, neat, etc.).

Figure 8:
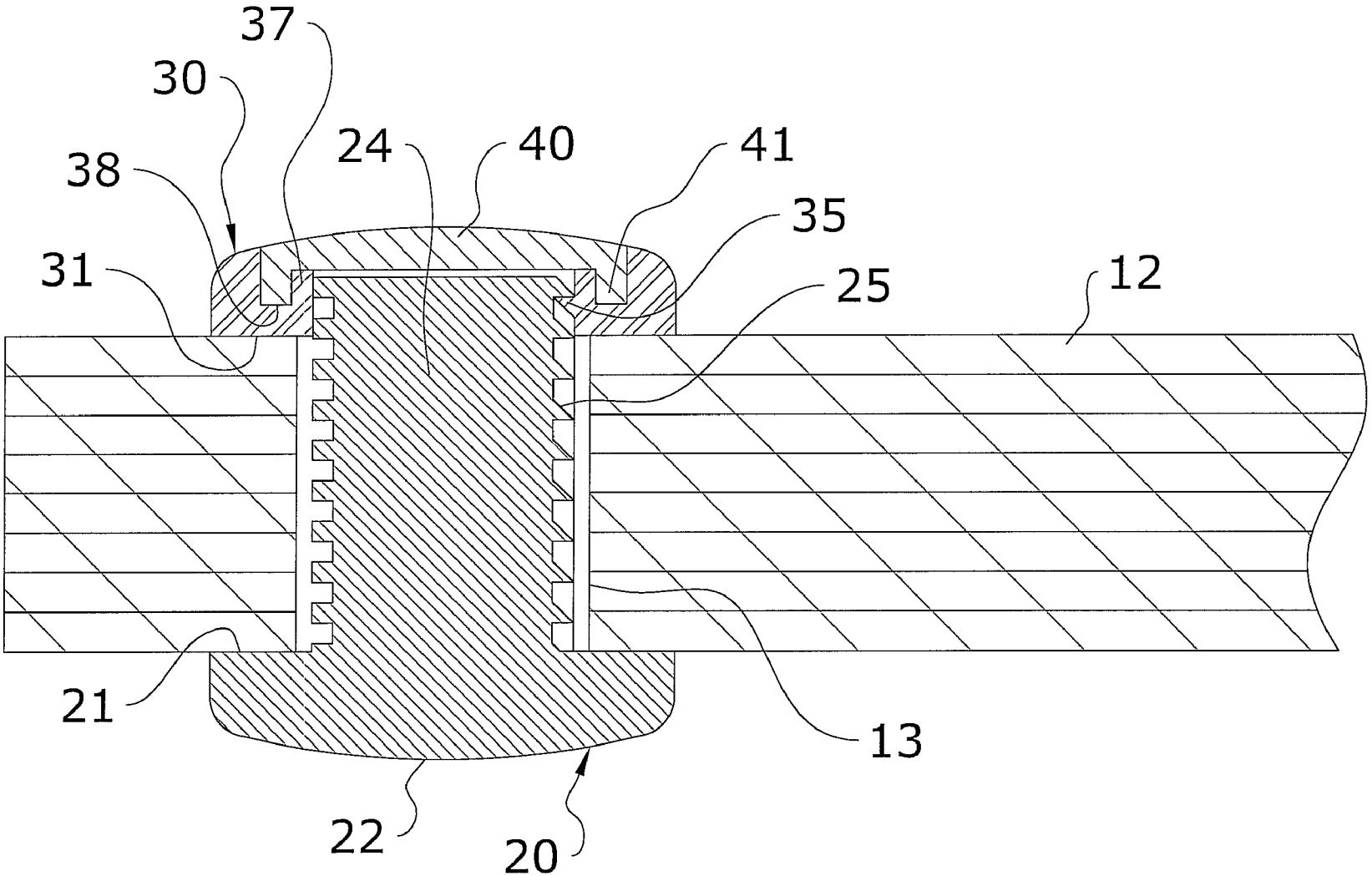
FIG. 8 is a cross-sectional view of the present invention binding the plurality of documents.
Figure 9:
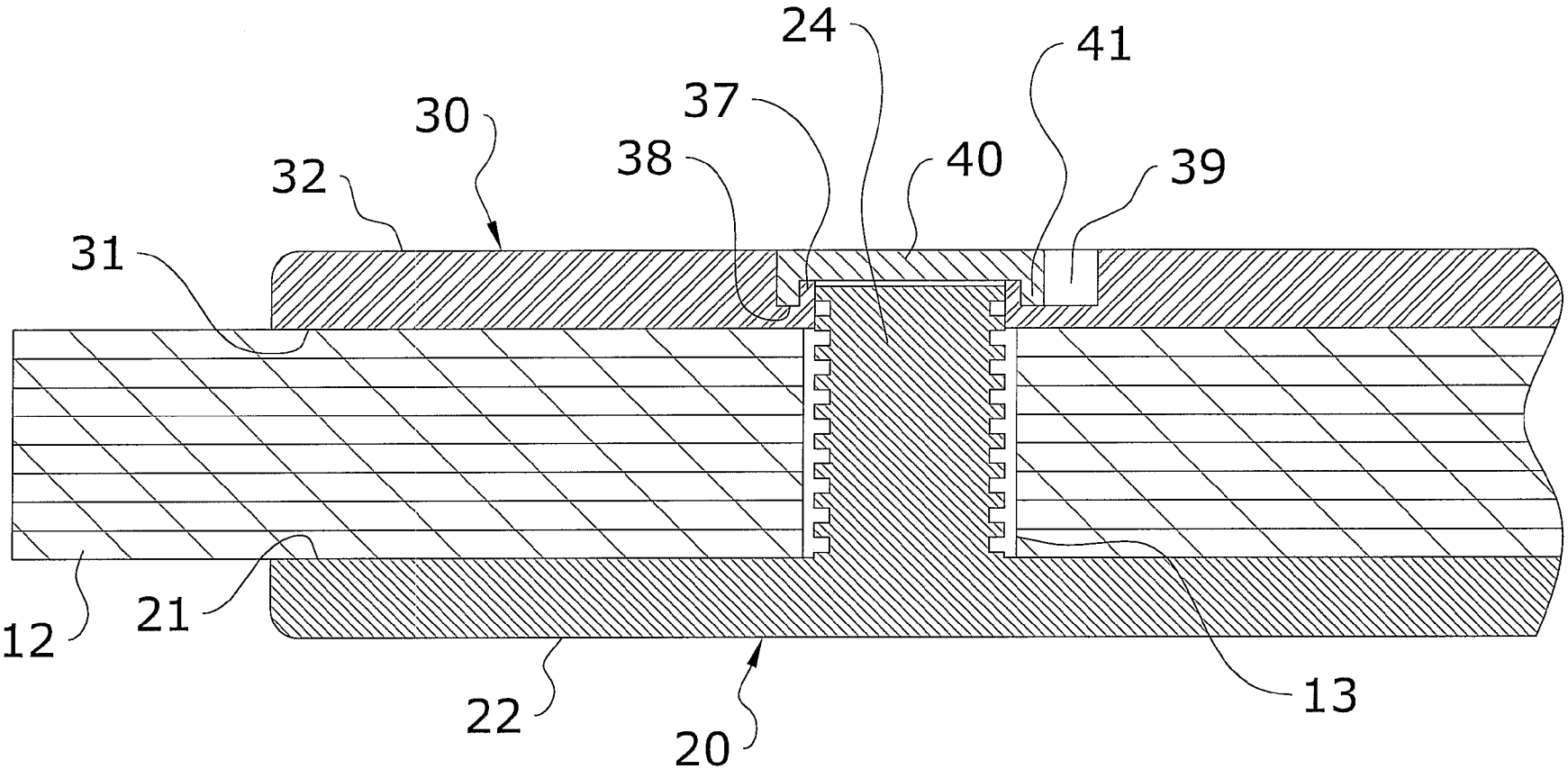
FIG. 9 is a longitudinal cross-sectional view of the present invention binding the plurality of documents.

The first inner side 21 of the first support 20 is preferably comprised of a substantially planar configuration so as to be uniformly positioned upon the document 12 as illustrated in FIGS. 8 and 9. It is appreciated that the first inner side 21 does not have to be comprised of a solid structure such as when the first inner side 21 is partially hollowed out to lessen the weight of the first support 20. In the case of hollowing out a portion of the first inner side 21, the outermost or protruding portion of the first inner side 21 is preferably ensured to be comprised of the planar configuration.

The first outer side 22 of the first support 20 may be comprised of various configurations. In the preferred embodiment of the present invention, the first outer side 22 is preferably comprised of a curved convex configuration as illustrated in FIG. 8. It is appreciated however that the first outer side 22 may be comprised of various configurations rather than the preferred embodiment, such as but not limited to planar.

The first support 20 also preferably includes a pair of posts 24 extending from the first support 20. The pair of posts 24 further preferably extends perpendicularly from the first inner side 21 of the first support 20, wherein the longitudinal axis of the posts 24 perpendicularly intersects the longitudinal axis of the first support 20. It is appreciated that the present invention may include more or less posts 24, such as when accommodating 3-hole 13 punch documents 12 or 1-hole 13 punch documents 12.

Figure 4:
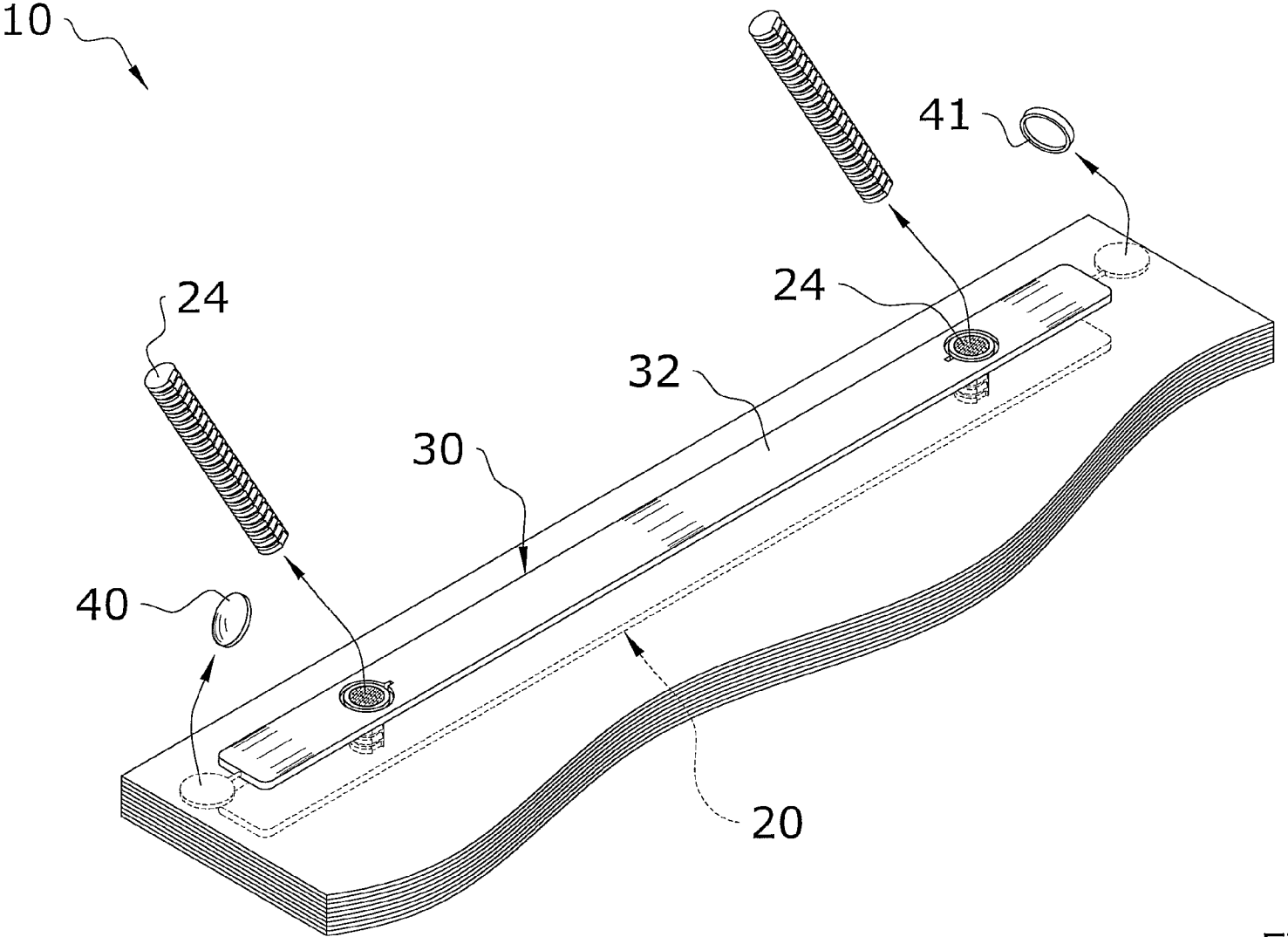
FIG. 4 is an upper perspective view of the present invention with the extra portion of the posts being broken off and the covers being removed from the connecting portion.
Figure 5:
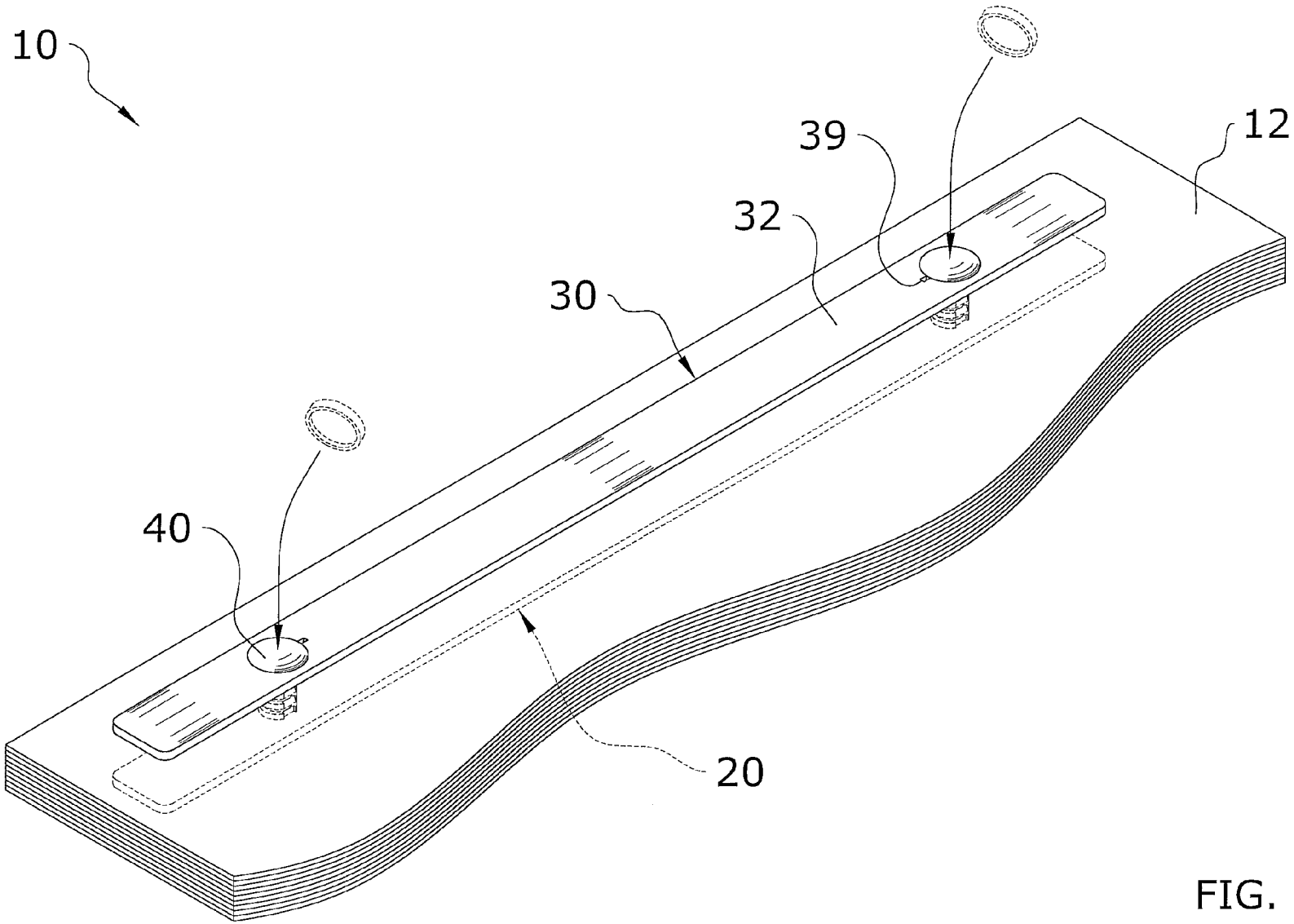
FIG. 5 is an upper perspective view of the present invention with the covers being positioned within the recessed portion.

The posts 24 are preferably comprised of a rigid and breakable structure, such as but not limited to plastic or wood. The posts 24 are also preferably comprised of a tubular configuration; however it is appreciated that the posts 24 may be comprised of various other elongated shaped configurations. The posts 24 are further preferably comprised of a solid structure. An extra portion of the posts 24 is generally broken off prior to positioning the cover 40 over the opening 34 when the second support 30 is attached to the first support 20 as illustrated in FIGS. 4 and 5.

The posts 24 are further comprised of an elongated configuration, wherein the present invention is able to attach upon a plurality of documents 12. The posts 24 and the first support 20 are preferably comprised of an integrally formed structure; however it is appreciated that the posts 24 and the first support 20 may be comprised of separate structures.

The posts 24 include a plurality of teeth 25 as illustrated in FIGS. 1 through 4. The plurality of teeth 25 preferably extend equidistantly along an outer surface of the post 24. It is appreciated that the plurality of teeth 25 may also circumscribe the posts 24. The plurality of teeth 25 preferably extend along an entire longitudinal length of the post 24 so any portion of the post 24 may be secured to the locking member 35 within the opening 34. It is also appreciated that the teeth 25 may extend along the post 24 in various intervals rather than equidistantly.

The teeth 25 may be comprised of various configurations all which may be secured by the locking member 35. In the preferred embodiment of the present invention the teeth 25 are comprised of a jagged configuration as illustrated in FIG. 8. The teeth 25 are also preferably secured upon the locking member 35 in a ratcheting manner to prevent the first support 20 from becoming loose from the second support 30. The teeth 25 and the posts 24 are preferably comprised of an integrally formed structure; however it is appreciated that the teeth 25 and the posts 24 may be comprised of separate structures.

C. Second Support

The second support 30 is comprised of an elongated configuration. The second support 30 is preferably positioned over a plurality of holes 13 extending along a side of a plurality of documents 12 and opposite the first support 20 as illustrated in FIGS. 1 through 6. The second support 30 preferably extends substantially along an entire edge of the plurality of documents 12 as illustrated in Figures X through X. It is appreciated that the second support 30 may extend along a longitudinal edge of the documents 12 or an adjacent edge (i.e. top edge, bottom edge) of the documents 12.

The second support 30 may be comprised of various materials such as but not limited to plastic, metal or wood. The second support 30 is preferably comprised of a substantially rigid material so as to provide adequate support along a given edge of the documents 12. The second support 30 is also comprised of a configuration to provide a professional appeal (i.e. sleek, neat, etc.).

The second inner side 31 of the second support 30 is preferably comprised of a substantially planar configuration so as to be uniformly positioned upon the document 12 as illustrated in FIGS. 8 and 9. It is appreciated that the second inner side 31 does not have to be comprised of a solid structure such as when the second inner side 31 is partially hollowed out to lessen the weight of the second support 30. In the case of hollowing out a portion of the second inner side 31, the outermost or protruding portion of the second inner side 31 is preferably ensured to be comprised of the planar configuration.

The second outer side 32 of the second support 30 may be comprised of various configurations. In the preferred embodiment of the present invention, the second outer side 32 is preferably comprised of a curved convex configuration as illustrated in FIG. 8. It is appreciated however that the second outer side 32 may be comprised of various configurations rather than the preferred embodiment, such as but not limited to planar.

The second support 30 also preferably includes a pair of openings 34 extending through the second support 30. The pair of openings 34 further preferably extend perpendicularly through the second support 30, wherein the longitudinal axis of the openings 34 perpendicularly intersects the longitudinal axis of the second support 30. It is appreciated that the present invention may include more or less openings 34, such as when accommodating 3-hole 13 punch documents 12 or 1-hole 13 punch documents 12. It is further appreciated that the number of openings 34 of the second support 30 conforms to the number of posts 24 of the first support 20.

Figure 2:
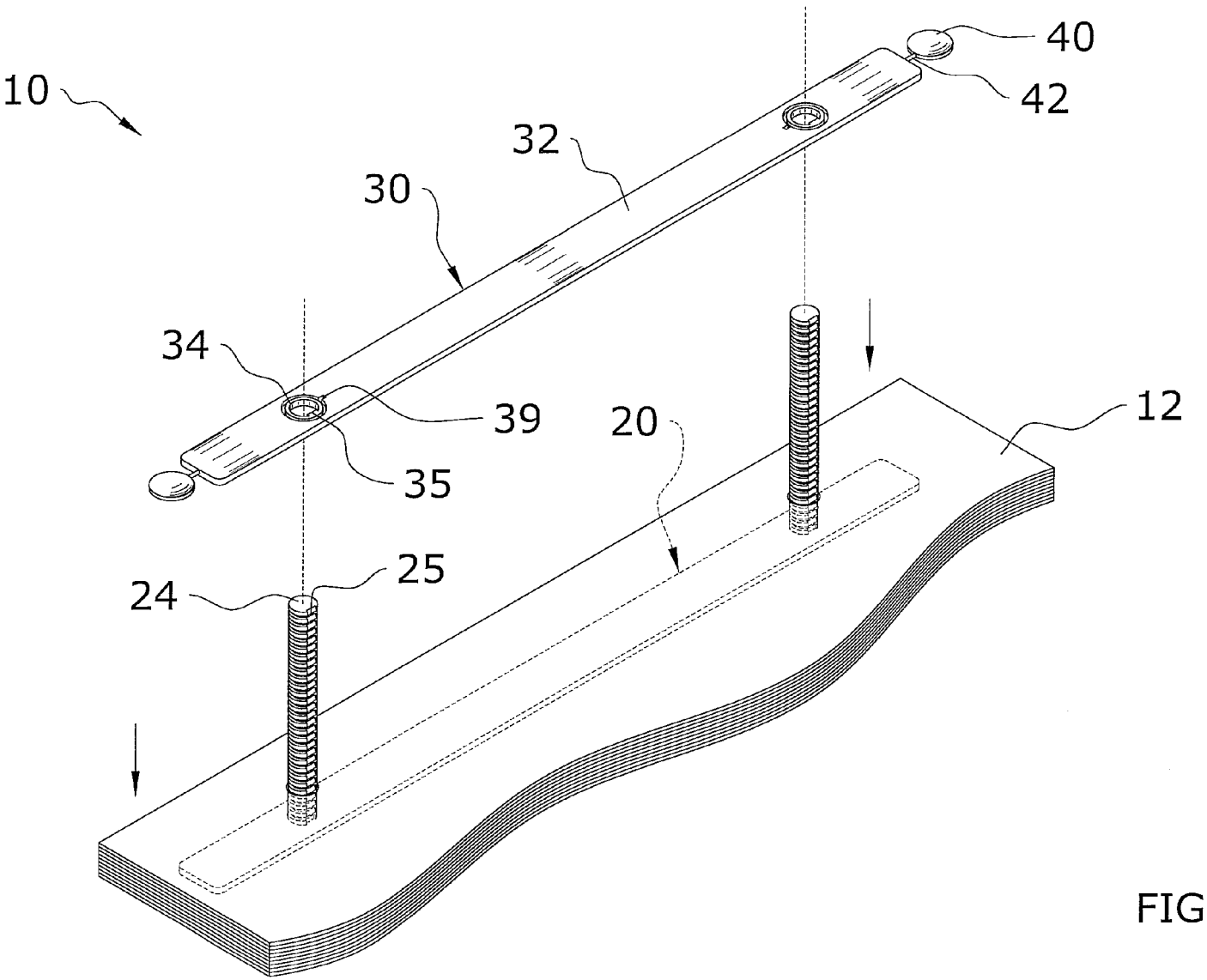
FIG. 2 is an upper perspective view of the present invention with the posts extending through the holes of the plurality of documents.
Figure 3:
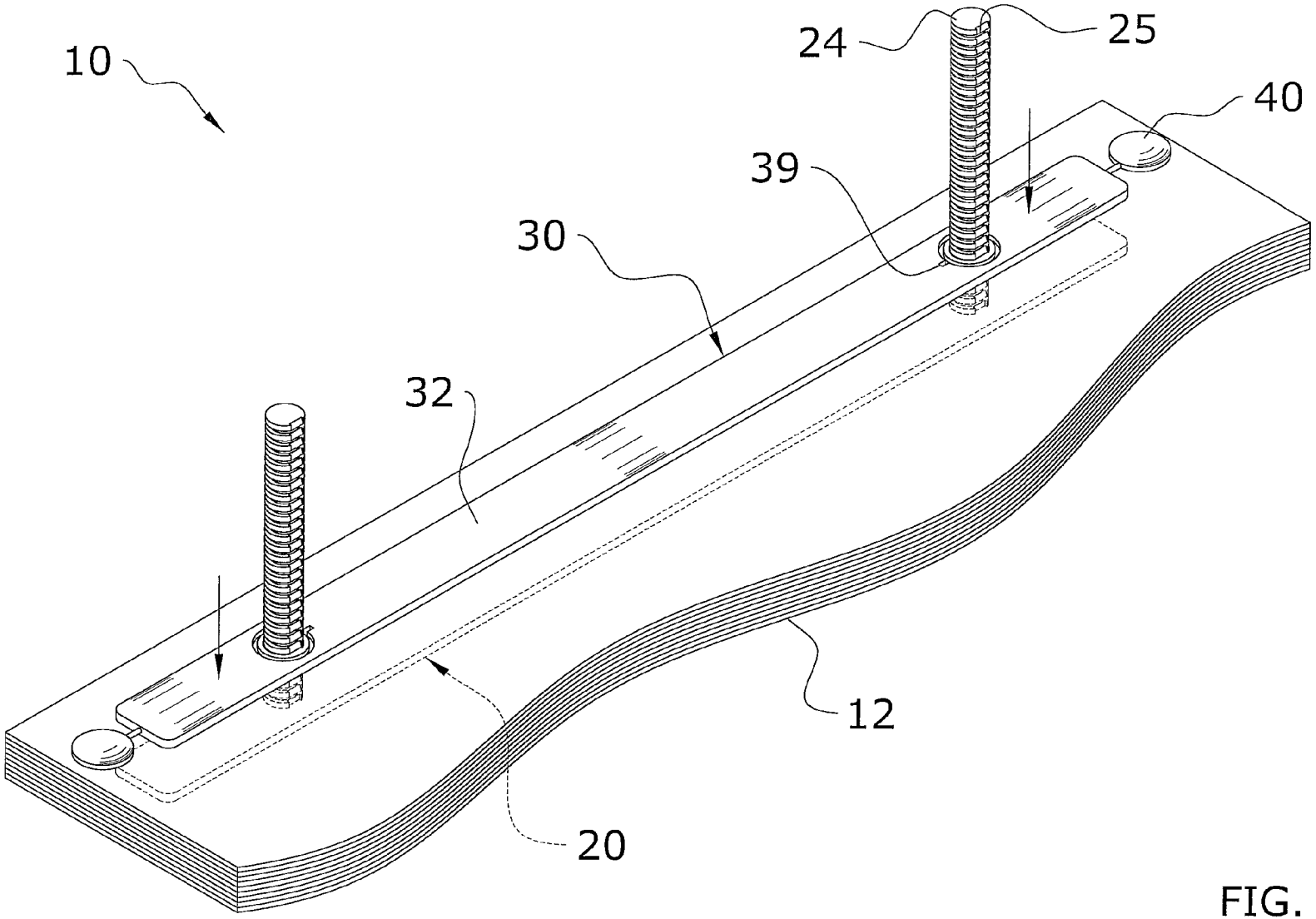
FIG. 3 is an upper perspective view of the present invention with the posts being extended through the openings of the second support.
Figure 7:
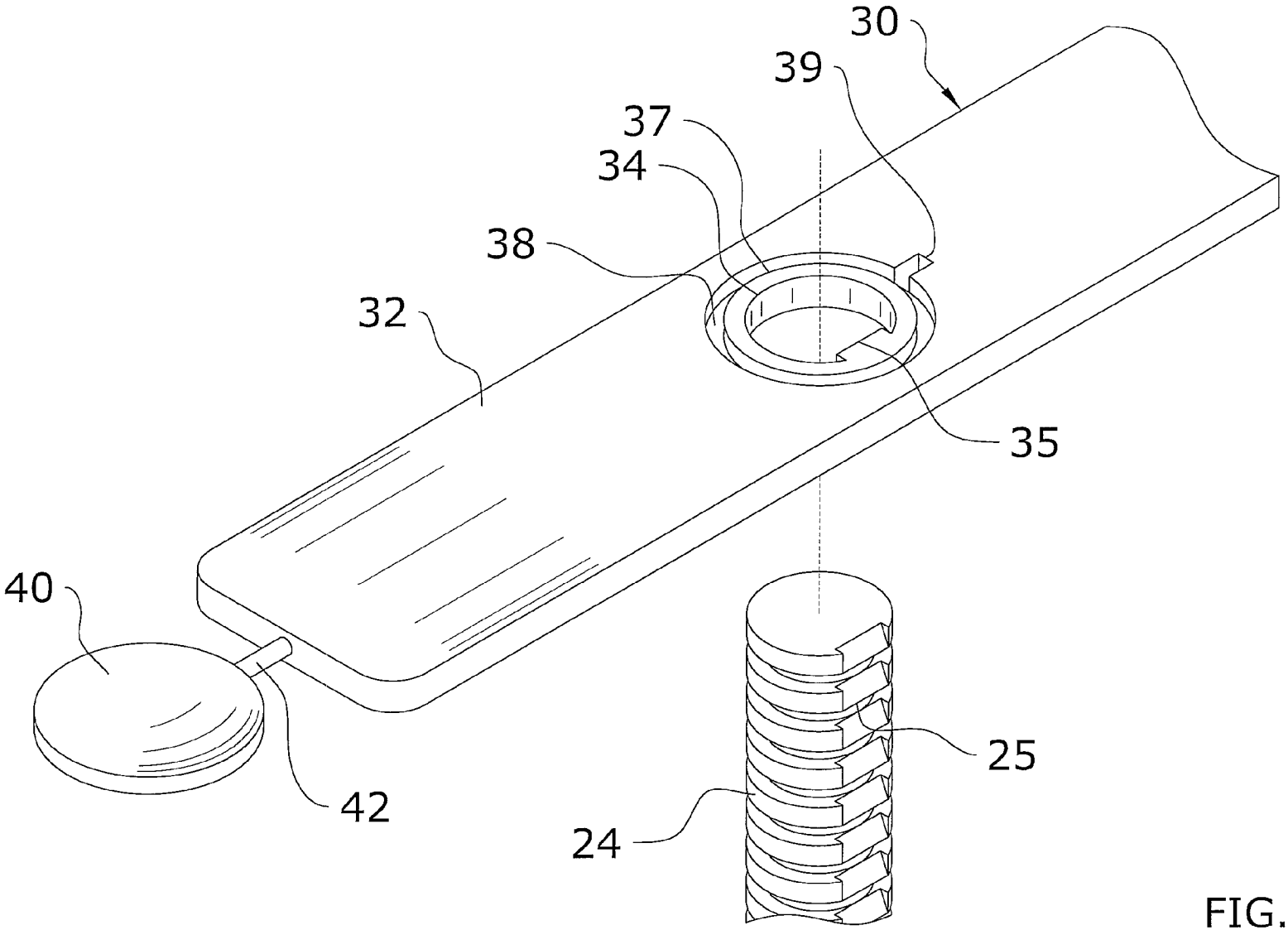
FIG. 7 is a magnified view of the opening of the second support.

The openings 34 each include a locking member 35 extending within the opening 34 as illustrated in FIGS. 7 and 8. The locking member 35 engages the teeth 25 of the posts 24, wherein the locking member 35 is selectively positioned between the consecutive teeth 25 as the openings 34 are extended in a forward direction over the posts 35 as illustrated in FIGS. 2 and 3. The locking member 35 also prevents the second support 30 from being extended in a reverse direction. The locking member 35 preferably does not engage the post 24, wherein the locking member 35 preferably only engages the teeth 25. The locking members 35 and the second support 30 are preferably comprised of an integrally formed structure; however it is appreciated that the locking members 35 and the second support 30 may be comprised of separate structures.

The second support 30 also preferably includes a recessed portion 37 surrounding each of the openings 34 to selectively receive a cover 40 as illustrated in FIG. 5. The recessed portions 37 preferably extend within the second outer side 32 of the second support 30 and are concentric with the respective openings 34. Each of the recessed portions 37 also preferably include a depression 38 extending further within the second support 30 and around the respective opening 34 as illustrated in FIGS. 7 and 8.

Each depression 38 preferably selectively receives a lip 41 of the respective cover 40, wherein the lip 41 is secured within the depression 38 between the opening 34 and the second support 30 as illustrated in FIGS. 7 through 9. The lip 41 and the depression 38 also help to ensure that the cover 40 remains secured within the recessed portion 37.

Each of the recessed portions 37 also preferably includes an indenture 39 extending outwardly from the recessed portions 37 and within the second support 30 as illustrated in FIGS. 1 through 7. The indenture 39 is connected to the recessed portion 37. The indenture 39 is also preferably positioned outside the cover 40, wherein the indenture 39 provides an area for an individual to pry up on the cover 40 if the cover 40 is desired to be removed.

D. Cover

Figure 6:
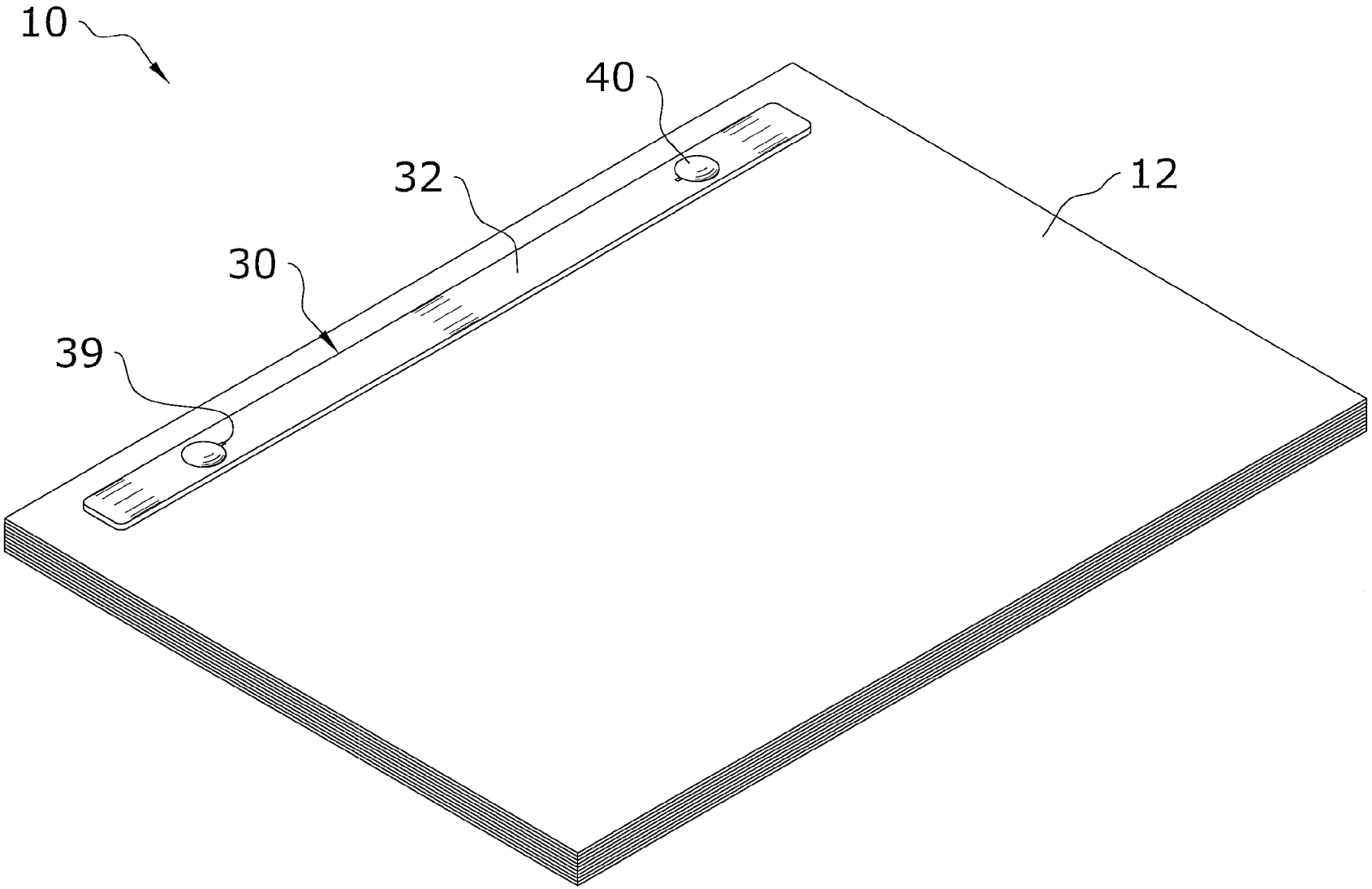
FIG. 6 is an upper perspective view of the present invention fully assembled and binding the plurality of documents.

The present invention preferably includes a pair of covers 40 to be positioned within the recessed portions 37, wherein each cover 40 conceals a respective opening 34 and post 24 as illustrated in FIGS. 5 and 6. It is appreciated that the present invention may include more or less covers 40, wherein it is appreciated that the number of covers 40 is similar to the number of openings 34.

The cover 40 may be comprised of various materials such as but not limited to plastic, metal or wood. The cover 40 is preferably comprised of a similar material as the second support 30 so as to provide a uniform appearance between the cover 40 and the second support 30. The cover 40 is also comprised of a configuration to provide a professional appeal (i.e. sleek, neat, etc.).

The outer surface of the cover 40 may be comprised of various configurations. In the preferred embodiment of the present invention, the outer surface of the cover 40 is preferably comprised of a curved convex configuration as illustrated in FIG. 8. The outer surface of the cover 40 is preferably comprised of a similar configuration as the second outer side 32 of the second support 30.

The outer surface of the cover 40 is further substantially flush with the second outer side 32 of the second support 30 when the cover 40 is positioned within the recessed portion 37 as illustrated in FIG. 8. It is appreciated however that the outer surface of the cover 40 may be comprised of various configurations rather than the preferred embodiment, such as but not limited to planar.

Before use of the cover 40, the cover 40 is preferably removably attached to the second support 30 via a connecting portion 42. The connecting portion 42 may subsequently be broken or snapped off when the cover 40 is desired to be utilized as illustrated in FIG. 4. The connecting portion 42 also preferably extends from an outer edge of the second support 30 as illustrated in FIGS. 1 through 3.

E. In Use

In use, the plurality of documents 12 that are preferred to be bound together are first aligned and oriented in a manner in which the documents 12 are to be presented or attached. A series of holes 13 are now preferably punched through the documents 12 along a given edge in which the documents 12 are desired to be bound. The holes 13 may be punched through the documents 12 in various manners, such as but not limited to utilizing a hole 13 puncher.

The configuration of the hole 13 puncher utilized (i.e. 2-hole 13, 3-hole 13, etc.) preferably matches up with the configuration of the present invention (i.e. 2 post 24, 3 post 24, etc.). The edge of the document 12 utilized also preferably matches up with the length of the supports 20, 30, wherein the supports 20, 30 preferably do not extend past the borders of the documents 12 as illustrated in FIGS. 1 through 6.

The first support 20 is now aligned with the holes 13 and the posts 24 are subsequently extended through the holes 13 until the first inner side 21 engages the outer document 12 as illustrated in FIGS. 1 and 2. The plurality of documents 12 may now be turned over and the openings 34 of the second support 30 are aligned with the posts 24. The locking members 35 are also positioned upon a similar side as the teeth 25 of the posts 24. The second support 30 is now projected towards the documents 12 thus extending the posts 24 through the openings 34 until the second inner side 31 of the second support 30 engages the documents 12 as illustrated in FIGS. 2 and 3.

The portion of the posts 24 extending past the second support 30 is now broken off substantially near the upper portion of the opening 34, wherein the remaining portion of the post 24 preferably does not extend substantially within the recessed portion 37 as illustrated in FIG. 4. The extra portion of the posts 24 may subsequently be discarded.

The covers 40 are now preferably broken off of a respective connecting portion 42 and positioned within the recessed portion 37 ensuring that the lip 41 is positioned within the depression 38 of the recessed portion 37 as illustrated in FIG. 5. The cover 40 is preferably pushed down until the outer convex surface of the cover 40 is substantially flush with the second outer side 32 of the second support 30 as illustrated in FIG. 8. The present invention is now fully assembled and permanently binding the documents 12. If the covers 40 are desired to be removed, a tool (i.e. screwdriver, pick, etc.) may be extended within the indenture 39 towards the opening 34. The cover 40 may subsequently be removed by prying upwards on the cover 40.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A method of binding a plurality of documents together, said method comprised of:

providing a plurality of documents including a first hole and a second hole;

providing a first support including a first post and a second post, wherein said first post and said second post are each comprised of a rigid and breakable structure, wherein said first post and said second post each extend outwardly from said first support substantially parallel to one another, wherein said first post and said second post each include a plurality of teeth, wherein said plurality of teeth each include a first upper surface and a first lower surface, wherein said first upper surface declines and wherein said first lower surface is substantially orthogonal with respect to a longitudinal axis of said at least one post;

providing a second support including a first opening and a second opening that each extend through said second support and are distally spaced apart approximately the same distance as said first post and said second post, wherein said second support includes a first depression surrounding said first opening and a second depression surrounding said second opening, wherein said first depression extends below an upper edge of said first opening and wherein said second depression extends below an upper edge of said second opening, wherein said second support includes a first ridge member separating said first depression from said first opening and wherein said second support includes a second ridge member separating said second depression from said second opening, wherein said first opening includes a first locking member extending within said first opening and a second locking member extending within said second opening that selectively engage at least one of said plurality of teeth in a ratcheting manner, wherein said first locking member and said second locking member each include a second upper surface and a second lower surface, wherein said second lower surface inclines and wherein said second upper surface is substantially orthogonal with respect to said longitudinal axis of said first post and said second post, and wherein said second upper surface is substantially parallel to said first lower surface;

extending said first post and said second post through said first hole and said second hole respectively of said plurality of documents so that an extended portion of said first post and said second post extend past the opposite side of said plurality of documents;

moving the second support towards said plurality of documents such that said extended portion of said first post and said second post extend through said first opening and said second opening with said first locking member and said second locking member ratcheting upon said plurality of teeth in a locking manner;

terminating said step of moving said second support towards said plurality of documents after said plurality of documents are securely retained between the respective inner surfaces said first support and said second support;

breaking off an extra portion of said first post and said second post extending outwardly past an outer surface of said second support so that the distal ends of said first post and said second post are substantially flush with said outer surface of said second support; and discarding said extra portion.

2. The method of claim 1, including:

providing a first cover and a second cover each having an extending lower peripheral lip;

inserting said lower peripheral lip of said first cover into said first depression to conceal said first opening; and inserting said lower peripheral lip of said second cover into said second depression to s conceal said second opening.

3. The method of claim 1, including:

providing a first cover and a second cover each having an extending lower peripheral lip, wherein said first cover and said second cover are connected to opposing ends of said second support, wherein each of said first cover and said second cover each have a breakable connecting portion temporarily securing said first cover and said second cover to said second support;

breaking said connecting portion of said first cover and said second cover to release said first cover and said second cover from said second support;

inserting said lower peripheral lip of said first cover into said first depression to conceal said first opening; and inserting said lower peripheral lip of said second cover into said second depression to s conceal said second opening.

4. The method of claim 1, wherein said second support includes a first slot extending from said first depression outwardly away from said first opening and wherein said second support includes a second slot extending from said second depression outwardly away from said second opening.

* * * * *